US005923923A

United States Patent [19]

Kobayashi et al.

[11] Patent Number: 5,923,923

[45] Date of Patent: Jul. 13, 1999

[54] TWO-SIDED IMAGE FORMING APPARATUS WITH OIL CONTAMINATION PREVENTION

[75] Inventors: Mikio Kobayashi; Ryoichi Tsuruoka, both of Ebina, Japan

[73] Assignee: Fuji Xerox Co., Ltd., Tokyo, Japan

[21] Appl. No.: 08/730,763

[22] Filed: Oct. 15, 1996

[30] Foreign Application Priority Data

Oct. 16, 1995 [JP] Japan ..... 7-267385

[51] Int. Cl.[6] ..... G03G 15/00

[52] U.S. Cl. ..... 399/98; 399/401

[58] Field of Search ..... 399/98, 101, 127, 399/297, 298, 299, 301, 312, 388, 401

[56] References Cited

U.S. PATENT DOCUMENTS 5,523,830 6/1996 Tamura et al. ..... 399/297
5,589,920 12/1996 Kubo et al. .
5,619,746 4/1997 Kubo et al. .

FOREIGN PATENT DOCUMENTS 1-262576 10/1989 Japan .
A-7-49599 2/1995 Japan .
A-7-181838 7/1995 Japan .
8-194344 10/1996 Japan .

*Primary Examiner*—Joan H. Pendergrass
*Attorney, Agent, or Firm*—Oliff & Berridge, PLC

[57] ABSTRACT

An image forming apparatus includes a control unit for executing a control operation in which the photoreceptor drum is not to directly contacted with a divided holding region surface on the transfer belt onto which a transfer sheet fed again by the trayless device is held. In the control operation, the two-sided image formation is previously conducted on the transfer sheets, the number of which corresponds to the surplus number (2) obtained when the number (7) of transfer sheets of continuous two-sided image formation is divided by the number (5) of the divided holding regions (panels) on the transfer belt passing through a transfer position on the photoreceptor drum in a period of time from when a transfer sheet, onto the first image surface of which an image is formed, is held on the transfer belt to when the transfer sheet is fed again to the transfer belt via a transfer sheet conveyance passage of the trayless mechanism, and then the two-sided image formation is conducted on the residual number (7−2=5) of transfer sheets.

12 Claims, 8 Drawing Sheets

FIG. 3

| NUMBER OF REVOLUTIONS OF TRANSFER BELT | TRANSFER BELT POSITION (PANEL NUMBER) | | | | |
|---|---|---|---|---|---|
| | 1 | 2 | 3 | 4 | 5 |
| FIRST REVOLUTION | S-1 | S-2 | S-3 | S-4 | S-5 |
| SECOND REVOLUTION | S-6 | S-7 | SKIP | | D-1 |
| THIRD REVOLUTION | D-2 | D-3 | D-4 | D-5 | D-6 |
| FOURTH REVOLUTION | D-7 | S-8 | S-9 | S-10 | S-11 |
| FIFTH REVOLUTION | S-12 | S-13 | S-14 | S-15 | S-16 |
| SIXTH REVOLUTION | D-8 | D-9 | D-10 | D-11 | D-12 |
| SEVENTH REVOLUTION | D-13 | D-14 | D-15 | D-16 | S-17 |
| EIGHTH REVOLUTION | S-18 | S-19 | S-20 | S-21 | S-22 |
| NINTH REVOLUTION | S-23 | S-24 | S-25 | D-17 | D-18 |
| TENTH REVOLUTION | D-19 | D-20 | D-21 | D-22 | D-23 |
| ELEVENTH REVOLUTION | D-24 | D-25 | | | |

FIG. 4

| NUMBER OF REVOLUTIONS OF TRANSFER BELT | TRANSFER BELT POSITION (PANEL NUMBER) | | | | | |
|---|---|---|---|---|---|---|
| | 1 | 2 | 3 | 4 | 5 | 6 |
| FIRST REVOLUTION | S-1 | S-2 | S-3 | SKIP | | |
| SECOND REVOLUTION | | | | | | D-1 |
| THIRD REVOLUTION | D-2 | D-3 | S-4 | S-5 | S-6 | S-7 |
| FOURTH REVOLUTION | S-8 | S-9 | S-10 | S-11 | S-12 | S-13 |
| FIFTH REVOLUTION | S-14 | D-4 | D-5 | D-6 | D-7 | D-8 |
| SIXTH REVOLUTION | D-9 | D-10 | D-11 | D-12 | D-13 | D-14 |
| SEVENTH REVOLUTION | S-15 | S-16 | S-17 | S-18 | S-19 | S-20 |
| EIGHTH REVOLUTION | S-21 | S-22 | S-23 | S-24 | S-25 | D-15 |
| NINTH REVOLUTION | D-16 | D-17 | D-18 | D-19 | D-20 | D-21 |
| TENTH REVOLUTION | D-22 | D-23 | D-24 | D-25 | | |

FIG. 7
PRIOR ART

| NUMBER OF REVOLUTIONS OF TRANSFER BELT | TRANSFER BELT POSITION (PANEL NUMBER) | | | | |
|---|---|---|---|---|---|
| | 1 | 2 | 3 | 4 | 5 |
| FIRST REVOLUTION | S-1 | SKIP | S-2 | | S-3 |
| SECOND REVOLUTION | | S-4 | | S-5 | D-1 |
| THIRD REVOLUTION | S-6 | D-2 | S-7 | D-3 | S-8 |
| FOURTH REVOLUTION | D-4 | S-9 | D-5 | S-10 | D-6 |
| FIFTH REVOLUTION | S-11 | D-7 | S-12 | D-8 | S-13 |
| SIXTH REVOLUTION | D-9 | S-14 | D-10 | S-15 | D-11 |
| SEVENTH REVOLUTION | S-16 | D-12 | S-17 | D-13 | S-18 |
| EIGHTH REVOLUTION | D-14 | S-19 | D-15 | S-20 | D-16 |
| NINTH REVOLUTION | S-21 | D-17 | S-22 | D-18 | S-23 |
| TENTH REVOLUTION | D-19 | S-24 | D-20 | S-25 | D-21 |
| ELEVENTH REVOLUTION | | D-22 | | D-23 | |
| TWELFTH REVOLUTION | D-24 | | D-25 | | |

... EMPTY PANEL ONTO WHICH MOLD RELEASING AGENT HAS ADHERED

*FIG. 8*
*PRIOR ART*

| NUMBER OF REVOLUTIONS OF TRANSFER BELT | TRANSFER BELT POSITION (PANEL NUMBER) | | | | | |
|---|---|---|---|---|---|---|
| | 1 | 2 | 3 | 4 | 5 | 6 |
| FIRST REVOLUTION | S-1 | SKIP | S-2 | | S-3 | |
| SECOND REVOLUTION | S-4 | | S-5 | | S-6 | D-1 |
| THIRD REVOLUTION | S-7 | D-2 | S-8 | D-3 | S-9 | D-4 |
| FOURTH REVOLUTION | S-10 | D-5 | S-11 | D-6 | S-12 | D-7 |
| FIFTH REVOLUTION | S-13 | D-8 | S-14 | D-9 | S-15 | D-10 |
| SIXTH REVOLUTION | S-16 | D-11 | S-17 | D-12 | S-18 | D-13 |
| SEVENTH REVOLUTION | S-19 | D-14 | S-20 | D-15 | S-21 | D-16 |
| EIGHTH REVOLUTION | S-22 | D-17 | S-23 | D-18 | S-24 | D-19 |
| NINTH REVOLUTION | S-25 | D-20 | | D-21 | | D-22 |
| TENTH REVOLUTION | | D-23 | | D-24 | | D-25 |

TWO-SIDED IMAGE FORMING APPARATUS WITH OIL CONTAMINATION PREVENTION

BACKGROUND OF THE INVENTION

1. Field of the Invention

The present invention relates to an image forming apparatus applied to a copier and printer. More particularly, the present invention relates to an image forming apparatus in which a toner image is fixed on a transfer sheet while a mold releasing. agent is being given onto the transfer sheet to prevent the occurrence of toner offset in the process of fixation, and further the image formation is automatically conducted on both the front and the reverse surface of the transfer. sheet while the transfer sheet is fed again to the transfer sheet holding rotary body, without reversing and temporarily accommodating the transfer sheet, on the first surface of which the fixation has been already completed.

2. Description of the Related Art

An example of this type full color image forming apparatus is shown in FIG. 5. This type full color image forming apparatus includes: a plurality of photoreceptor drums 100 on which toner images are formed by means of electrophotography while they are rotated in the direction of an arrow in the drawing; and a transfer belt 102 arranged at a transfer position of each photoreceptor drum 100 in such a manner that the transfer belt 102 comes into contact with each photoreceptor drum 100, wherein the transfer belt 102 is capable of simultaneously conveying a plurality of transfer sheets 101 onto which toner images have been transferred. In this image forming apparatus, toner images on the photoreceptor drums 100 are successively transferred onto the transfer sheets 101 fed onto and held by the transfer belt 102. After the completion of transfer, the transfer sheets 101 are made to pass in a fixing unit 103 in which the toner images are fixed while an oil-like mold releasing agent is given onto the transfer sheets. In this way, a color image can be formed.

In this type full color image forming apparatus, there is provided an automatic two-sided image forming means having "a trayless mechanism", which will be described below. In the process of two-sided image formation, the transfer sheet 101, onto the first surface of which the fixation has been completed, is made to pass in the sheet conveyance passage 104 shown by a dotted line in the drawing, so that the transfer sheet 101 is reversed. Then the reversed transfer sheet is fed again to the transfer belt 102 and held in a divided holding region on the transfer belt which is previously set in accordance with the length of the transfer sheet 101 in the conveyance direction before the start of image formation. While the transfer sheet is held in this divided holding region on the transfer belt, the image formation is conducted on the second surface.

In this connection, in the image forming apparatus including the automatic two-sided image forming means provided with the above trayless mechanism, the following problems may be encountered. Especially when the image formation is continuously conducted on both sides of a plurality of transfer sheets, a mold releasing agent coated on the first surface of the transfer sheet 101 in the process of image fixation on the first surface adheres onto the transfer belt 102 which reverses and holds the transfer sheet 101 in the process of image formation on the second surface. Further, the mold releasing agent which has adhered onto the transfer belt 102 moves to the photoreceptor drum 100 which comes into contact with the transfer belt 102. Therefore, the mold releasing agent which has adhered onto the photoreceptor drum 100 could be a cause of stripe-shaped oil stains that appear on a toner image.

Referring to an example in which images are formed on both sides of 7 transfer sheets of size A3 which are held and conveyed in a longitudinal direction on the transfer belt, adhesion of a mold releasing agent onto the photoreceptor drum caused in the process of automatic two-sided image formation will be explained as follows. FIG. 6 is a view showing a state of feeding in which the transfer sheets 101 are fed onto the transfer belt 102 in the process of automatic two-sided image formation. The transfer belt 102 shown in FIG. 6 is an endless belt, the entire circumference of which is developed into a sheet-shape for the convenience of explanation. FIG. 6 shows a state of the transfer belt in every revolution. In the example shown in the drawing, the entire length of the transfer belt 102 is divided into three equal portions, and the thus equally divided portions are defined as panels 1, 2 and 3. In this way, the divided holding region can be set in which each transfer sheet is held. In the drawing, "S" represents a transfer sheet fed and held for the formation of the first surface image, and "D" represents a transfer sheet fed and held for the formation of the second surface image. Also, in the drawing, "Skip" represents a panel for skipping on which no transfer sheet is held.

In the drawing, images are formed on both sides of transfer sheets as follows. While the transfer sheets (S-1) to (S-7) on which the first surface images are to be formed are made to skip by one panel, they are fed and held on the transfer belt 102, so that the first surface image formation is conducted. At the same time, the transfer sheets onto which the first surface images have been formed are successively fed again onto the transfer belt 102 via the trayless mechanism. In the second revolution of the transfer belt 102, one panel is made to skip on the panel 3. According to the above pattern, the transfer sheets are held on the transfer belt 102, and the second surface image formation is conducted. In this example, in the section from the panel 3 of the second revolution of the transfer belt to the panel 3 of the fifth revolution of the transfer belt, the first surface image formation and the second surface image formation are alternatively conducted.

However, on the transfer belt 102 onto which all transfer sheets for the formation of the first surface image have been fed, "empty panels" 105 are formed in which the transfer sheets are not held, that is, the panel 3 in the fifth revolution and the panel 2 in the sixth revolution are formed to be empty. In this two-sided image forming process, the transfer sheets finally held in "the empty panels" are the transfer sheets D-4 and D-5 on which the first surface image formation has been completed. Accordingly, the mold releasing agent that has been coated onto the first surface of the transfer sheet is made to adhere onto "the empty panel" 105. After such a transfer sheet has been peeled off from the transfer belt 102, "the empty panel" on the transfer belt 102 comes into contact with the photoreceptor drum 100. In the manner described above, the mold releasing agent coated on the transfer sheet 101 in the process of fixation adheres onto the photoreceptor drum 100 via the transfer belt 102.

In this connection, in the automatic two-sided image forming means having the trayless mechanism, a predetermined period of time is required for the transfer sheet, on the first surface of which an image has been formed, to arrive at a feed position on the transfer belt 102 via the trayless mechanism. Therefore, the panel on which the first transfer sheet after the completion of the first surface image formation is held after it has been fed again to the transfer belt 102, is actually limited to a panel which can hold the first transfer sheet conveyed again in a predetermined period of time in timed relation. In this example, the panel in which the first transfer sheet after the completion of the first surface image formation is held after it has been fed again to the transfer belt 102, is actually limited to the panel 3 in the second revolution.

Conventionally, there is disclosed a technique by which the problem of adhesion of a mold releasing agent to the photoreceptor drum can be solved in the case of two-sided image formation conducted on a plurality of continuous transfer sheets by an apparatus having a stack tray unit. This technique is disclosed in Japanese Unexamined Patent Publication Nos. 7-49599 and 7-181838. The apparatus having the stack tray unit is an automatic two-sided image forming means including an intermediate tray exclusively used for the two-sided image formation in which all transfer sheets are reversed and temporarily accommodated after the completion of fixation of the first surface image, and the transfer sheets accommodated in the intermediate tray exclusively used for the two-sided image formation are fed again onto the transfer belt in the process of the second surface image formation.

The above technique is described as follows. In the image forming apparatus, there is provided a transfer sheet carrier (transfer drum), arranged coming into contact with the photoreceptor drum, on which a plurality of transfer sheets are held so that a toner image on the photoreceptor drum can be transferred onto each transfer sheet. Transfer sheets, the number of which corresponds to a surplus obtained when the number of transfer sheets of continuous image formation is divided by the number of transfer sheets which the transfer drum can hold simultaneously, are first held on the transfer drum so as conduct image formation. That is, the second surface image formation is conducted on the transfer sheets accommodated in the intermediate tray after the completion of the first surface image formation. Specifically, the image formation is conducted as follows. When images are formed on both sides of 5 transfer sheets by a transfer drum capable of simultaneously holding 2 transfer sheets, the second surface image formation is conventionally conducted in the sequence of 2 sheets-2 sheets-1 sheet, however, in the above image forming apparatus, the second surface image formation is conducted in the sequence of 1 sheet-2 sheets-2 sheets while the transfer sheets are held on the transfer drum.

However, the aforementioned technique is an effective solution means only for an image forming apparatus having the stack tray unit by which images are formed on both sides of transfer sheets. That is, the aforementioned technique can not be applied to an image forming apparatus in which images are formed on both sides of transfer sheets by the trayless mechanism. The aforementioned technique is not an effective solution means.

SUMMARY OF THE INVENTION

The present invention has been made in view of the above circumstances, and therefore an object of the present invention is to provide an image forming apparatus capable of simply solving a problem of the deterioration of image quality caused by adhesion of a mold releasing agent onto the rotary image carrier when images are formed on both sides of transfer sheets by the above trayless mechanism, at least without lowering the speed (without extending a required period of time) of image formation on both sides of the transfer sheets.

In order to accomplish the above object, according to the present invention, there is provided an image forming apparatus comprising: a rotary image carrier on which a toner image is formed; a transfer sheet carrying rotary body arranged at a transfer position of the rotary image carrier, capable of carrying a plurality of transfer sheets onto which the toner image is transferred from the rotary image carrier; a fixing means for fixing transferred toner onto the transfer sheets, having a mold releasing agent coating means; an automatic two-sided image forming means for feeding again a transfer sheet, onto the first surface of which the toner image has been fixed, to the transfer sheet carrying rotary body without reversing and temporarily accommodating the transfer sheet, the automatic two-sided image forming means also for forming an image on the second surface of the transfer sheet while the transfer sheet is being held in a divided holding region on the transfer sheet carrying rotary body which is previously set before the start of image formation; and a control means for conducting a control operation so that the divided holding region surface of the transfer sheet carrying rotary body, on which the transfer sheet fed again by the automatic two-sided image forming means is held, can not be directly contacted with the rotary image carrier.

The above automatic two-sided image forming means includes the trayless mechanism described before. The divided holding region on the transfer sheet holding rotary body which is previously set before the start of image formation is appropriately determined in accordance with the size of transfer sheets to be used and the length of transfer sheets in the conveyance direction when they are held on the transfer belt.

The control operation to carry out the above control means is conducted to displace the transfer sheet carrying rotary body so that the divided holding region surface of the transfer sheet carrying rotary body, onto which the transfer sheet fed again is held, can be separated from the rotary image carrier.

In this case, in an apparatus in which the transfer sheet holding rotary body is contacted with the rotary image carrier by pushing the transfer sheet holding member against the rotary image carrier, while the divided holding region surface of the transfer sheet holding rotary body, on which the transfer sheet that has been fed again is held, passes through the rotary image carrier, the pushing motion conducted by the pushing member may be stopped, so that the transfer sheet holding member can be separated from the rotary image carrier. In an apparatus in which the rotary image carrier can be displaced, the rotary image carrier may be displaced, so that it can be separated from the transfer sheet holding member.

Concerning the control operation, a transfer sheet is fed again so that it can be fed onto the divided holding region surface of the transfer sheet holding rotary body.

Concerning the transfer sheet to be fed, for example, a new transfer sheet accommodated in the sheet tray is used. The new transfer sheet is fed in timed relation so that it can be held on a predetermined divided holding region surface.

Concerning the control operation, the control operation is conducted to previously deposit toner at least on a surface of the rotary image carrier which comes into contact with the divided holding region surface of the transfer sheet carrying rotary body, onto which the transfer sheet fed again is held.

In this case, toner may be deposited on the rotary image carrier by the developing unit used for forming a toner image on the rotary image carrier. It is preferable that a magnetic brush formed by the two-component developing unit is contacted with the rotary image carrier, so that toner can be deposited on the rotary image carrier, and the deposited toner is recovered into the developing unit.

Concerning the control operation, the two-sided image formation is previously conducted on the transfer sheets, the number of which corresponds to the number (Q) of a surplus obtained when the number (M) of transfer sheets of continuous two-sided image formation is divided by the number (S) of the divided holding regions on the transfer sheet holding rotary body passing through a transfer position on the rotary image carrier in a period of time from when a transfer sheet, onto the first image surface of which an image is formed, is held on the transfer sheet holding rotary body to when the transfer sheet is fed again to the transfer sheet carrying rotary body via a transfer sheet conveyance passage of the automatic two-sided image forming means, when the two-sided image formation is continuously conducted on a plurality of transfer sheets, and then the two-sided image formation is conducted on the residual number (M−Q) of transfer sheets. In the above explanation, characters M, S and Q are positive integers containing 0.

In this case, in the number (S) of the divided holding regions of the transfer sheet holding rotary body which pass through the transfer position of the rotary image carrier, the divided holding region, in which a transfer sheet fed for the first surface image formation is held, is included, and the divided holding region, in which the transfer sheet is held when it is fed again to the transfer sheet holding rotary body, is not included. A relation among the above numerical values can be expressed by the expression M=Sn+Q. In the above expression, n is a positive integer including 0. Accordingly, the residual number (M−Q) can be also expressed by Sn.

In this case, the transfer position of the rotary image carrier through which the divided holding region passes is located at a transfer position of the first rotary image carrier arranged on the side to which the transfer sheet is fed when a plurality of rotary image carriers are arranged around the transfer sheet holding rotary body. The number of the divided holding regions which pass through the aforementioned transfer position is adopted for the above number (S).

In this case, both the two-sided image formation conducted on transfer sheets, the number (Q) of which corresponds to the number (Q) of a surplus, and the two-sided image formation conducted on the residual transfer sheets, the number of which corresponds to the residual number (M−Q), are respectively conducted under the condition that the transfer sheet, onto the first surface of which an image is formed, and the transfer sheet, onto the second surface of which an image is formed, are successively held in the divided holding regions on the transfer sheet holding rotary body, without setting a divided holding region for skipping in which a transfer sheet is not held. However, there is a divided holding region that is impossible to hold a transfer sheet because it passes in the period of time in which the first transfer sheet is conveyed in the transfer sheet passage of the automatic two-sided image forming means and fed again to the transfer sheet holding rotary body. This divided holding region naturally becomes a divided holding region for skipping, however, this region is not included in the aforementioned divided holding region for skipping.

In this case, the transfer sheet holding rotary body is displaced so that it can be separated from the rotary image carrier after the completion of transfer conducted on the second surface in the two-sided image formation conducted on the residual number (M−Q) of transfer sheets. When there are provided a plurality of rotary image carriers, the transfer sheet holding rotary body is displaced so that it can be separated from all the rotary image carriers. The thus separate transfer sheet holding rotary body is made to come into contact with the rotary image carrier in timed relation with the start of the next image forming operation.

As described above, after the two-sided image formation has been conducted on the transfer sheets, the number of which corresponds to the surplus number, the two-sided image formation is conducted on the residual number of transfer sheets. Due to the foregoing, it is possible to prevent the deterioration of image quality caused by the adhesion of a mold releasing agent to the rotary image carrier, and it is also possible to increase the image forming speed. The above effect is remarkable especially when the number (R) of the divided holding regions of the transfer sheet holding rotary body is set to be an even number. In this connection, when the above number (R) of the divided holding regions is set to be an even number, even if the control operation of the present invention is not conducted so as to control the feed of a transfer sheet to the transfer sheet holding rotary body, that is, even if a transfer sheet is fed to and held by the transfer sheet holding rotary body on which the divided holding region for skipping is set, it is possible to prevent the deterioration of image quality caused by the adhesion of a mold releasing agent to the rotary image carrier.

In the above technical means, the rotary image carrier or photoreceptor is made of dielectrics, and its form may be a drum or belt. Fundamentally, a plurality of rotary image carriers are arranged, however, only one rotary image carrier may be arranged. Fundamentally, the form of the transfer sheet holding rotary body is a belt, however, the form of the transfer sheet holding rotary body may be a drum.

BRIEF DESCRIPTION OF THE DRAWINGS

The above and other objects and features of the present invention will be more apparent from the following description taken in conjunction with the accompanying drawings.

FIG. 3 is a development view showing another example of the model of the transfer sheet conveyance pattern to convey transfer sheets onto a transfer belt divided into panels, the number of which is odd;

FIG. 4 is a development view showing an example of the model of the transfer sheet conveyance pattern to convey transfer sheets onto a transfer belt divided into panels, the number of which is even;

FIG. 6 is a development view showing an example of the model of the conventional transfer sheet conveyance pattern to convey transfer sheets onto a transfer belt divided into panels, the number of which is odd, wherein FIG. 6 is compared with FIG. 2;

FIG. 7 is a development table showing an example of the model of the conventional transfer sheet conveyance pattern to convey transfer sheets onto a transfer belt divided into panels, the number of which is odd, wherein FIG. 7 is compared with FIG. 3; and FIG. 8 is a development table showing an example of the model of the conventional transfer sheet conveyance pattern to convey transfer sheets onto a transfer belt divided into panels, the number of which is even, wherein FIG. 8 is compared with FIG. 4.

DETAILED DESCRIPTION OF THE PREFERRED EMBODIMENTS

Now, a description will be given in more details of embodiments of the present invention with reference to the accompanying drawings.

Figure 1:
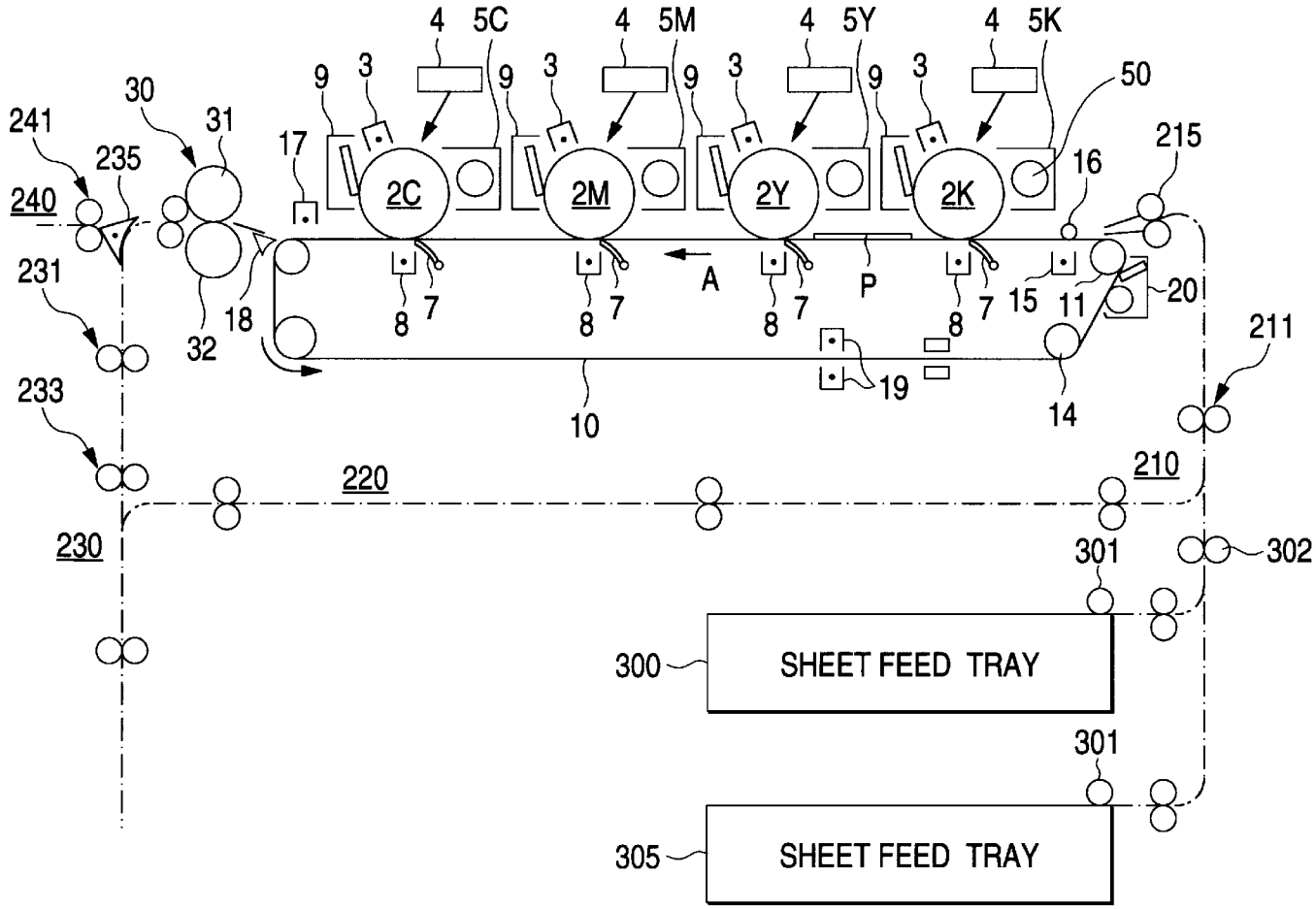
FIG. 1 is a schematic illustration showing an arrangement of the full color image forming apparatus relating to an embodiment of the present invention.

FIG. 1 is a schematic illustration showing a primary portion of the full color image forming apparatus which is an embodiment of the present invention.

This full color image forming apparatus includes photoreceptor drums 2K, 2Y, 2M, 2C which are rotary image carriers rotatably supported on rotary shafts. There is provided an image forming means in the outer circumferential portion of each photoreceptor drum. An arbitrary image forming means may be adopted. In this embodiment, each image forming means includes: a charger 3 to uniformly charge the surface of the photoreceptor drum; an exposure means 4 of a laser beam system to form an electrostatic latent image on each photoreceptor drum by irradiating a color-separated optical image or an optical image corresponding to that; and a developing unit 5K, 5Y, 5M, 5C to visualize the electrostatic latent image on each photoreceptor drum. In the outer circumferential portion of each photoreceptor drum, there are provided a corona discharger 8 for transferring an image and a cleaner 9 for cleaning the photoreceptor drum.

Two-component developers of 4 colors of black (K), yellow (Y), magenta (M) and cyan (C) are respectively accommodated in the developing units 5K, 5Y, 5M and 5C. When a magnetic brush formed on the developing roller 50 is made to rub on the photoreceptor drum surface, toner is deposited on an electrostatic latent image, that is, the contact type magnetic brush development is conducted. Toner images of 4 colors are respectively formed on the photoreceptor drums 2 by the developing units 5.

Under each photoreceptor drum 2K, 2Y, 2M, 2C, there is provided a transfer sheet belt conveying unit in which a seamless, endless transfer belt 10 is trained round a driving roller 11 and trailing rollers 12 to 14, so that the transfer belt 10 can be moved in the direction of arrow A. This transfer belt 10 functions as a transfer sheet holding rotary body and comes into contact with the photoreceptor drum surface at the transfer position of each photoreceptor drum by the action of a transfer baffle 7 which is moved in the upward and downward direction by a retractor mechanism not shown in the drawing. In this image forming apparatus, all transfer baffles 7 are simultaneously pushed immediately before the image exposure conducted on the first photoreceptor drum 2K by laser beams emitted by the exposure means 4. All transfer baffles 7 are simultaneously withdrawn immediately after the final transfer sheet has passed through the final photoreceptor drum 2C. On the upstream side of the photoreceptor drum 2K of the first color, there are provided a corona discharger 15 for attracting a transfer sheet and an attraction roller 16 which is arranged at a position opposed to the corona discharger 15 with respect to the transfer belt 10. A transfer sheet P fed from the sheet feed unit is electrostatically attracted onto the transfer belt 10.

This transfer sheet belt conveying unit holds the transfer sheet P and conveys it to a transfer position which is opposed to each photoreceptor drum 2. By the action of this transfer sheet belt conveying unit, toner images formed on the photoreceptor drums 2 are successively transferred onto the transfer sheet P.

On the downstream side of the photoreceptor drum 2C, in the outer circumferential portion on the transfer belt 10, there are provided a corona discharger 17 for separation use and a separation claw 18. By the action of corona discharger 17 and separation claw 18, the transfer sheet P is separated from the transfer belt 10 after the completion of transfer. The separated transfer sheet P is usually guided to the fixing unit 30. The fixing unit 30 includes a heat roller 31 and a pressure roller 32 which are arranged being opposed to each other. At least one of the heat roller 31 and the pressure roller 32 is equipped with a mold releasing agent coating means (not shown) for coating a mold releasing agent (referred to as "oil" hereinafter) such as silicon oil for the prevention of toner offset and curl of the transfer sheet round the roller.

The transfer belt 10 is electrically discharged by the discharger 19 for belt use which is arranged being opposed to the transfer belt after the completion of separation of the transfer sheet P. After the transfer belt 10 has been electrically discharged, the belt surface is cleaned by the cleaner 20 for belt use having a cleaning brush and blade, arranged on the downstream side of the discharger 19. In this way, the transfer belt is ready for the next rotational operation.

In this image forming apparatus, the sheet conveying system is composed as follows. The sheet conveying system includes: a feed side conveyance passage 210 to guide the transfer sheet P from the sheet feed tray 300 to the transfer belt 10; a two-sided image formation conveyance passage 220 to convey the transfer sheet P when the two-sided image formation (print) is conducted; a sheet reversal conveyance passage 230 to guide the transfer sheet P, which has passed through the fixing unit 30, to the two-sided image formation conveyance passage 220; and a delivery side conveyance passage 240 to guide the transfer sheet P, on one side or both sides of which printing has been completed, onto the delivery tray.

In the above sheet conveyance system, the transfer sheet P is fed from the sheet feed tray 300 or 305, which is provided to feed sheets of various sizes, to the feed side conveyance passage 210 by the action of the feed roller 301 and conveyance roller 302. Then the transfer sheet P is conveyed in the feed side conveyance passage 210 by the conveyance roller 211 and temporarily positioned by the register gate 215. After that, the transfer sheet P is fed onto the transfer belt 10 in a predetermined timed relation. Then the transfer sheet P is electrostatically attracted and conveyed by the transfer belt 10. During the conveyance, toner images are successively transferred onto the surface of the transfer sheet P, and then the transfer sheet P is separated from the transfer belt 10. Then the toner image on the transfer sheet P is thermally fixed by the fixing unit 30. In the process of fixation, a large quantity of mold releasing agent is coated on the surface of the transfer sheet P.

There is provided a changeover gate 235 at a position where the delivery side conveyance passage 240 crosses the transfer sheet reversal conveyance passage 230. In the case of one-sided printing, this changeover gate 235 is changed over to the delivery side conveyance passage 240. Due to the foregoing, the transfer sheet P, on the first surface (front surface) of which an image has been printed, is discharged by the conveyance roller 241 via the delivery side conveyance passage 240.

In the case of two-sided printing, the changeover gate 235 is changed over to the sheet reversal conveyance passage 230. Due to the foregoing, the transfer sheet P, on the first surface of which printing has been conducted, is sent to the sheet reversal conveyance passage 230. The transfer sheet P is reversed while it is conveyed in the conveyance passage. Then the transfer sheet P is sent to the two-sided image formation conveyance passage 220. This transfer sheet P is conveyed onto the upstream side of the belt conveyance unit by the conveyance roller 211. Therefore, the transfer sheet P is conveyed again onto the transfer belt 10, so that a toner image is transferred onto the second surface (reverse side). After the completion of printing on the second surface, the transfer sheet P is delivered by the conveyance roller 241 via the delivery side conveyance passage 240.

As described above, this image forming apparatus automatically, continuously conducts the two-sided printing operation, wherein the image forming apparatus has no stack tray for temporarily accommodating all reverse transfer sheets, on the first surfaces of which printing has been conducted. This type automatic two-sided printing mechanism will be referred to as "a trayless device" in this specification, hereinafter.

This image forming apparatus is equipped with an image memory, the capacity of which is twice as large.as that of the maximum sheet size. In the case of two-sided printing, for example, first, an image on the first surface of the original is stored by the image reading unit. Successively, another image on the second surface is stored. After that, image formation (two-sided printing) is started.

When two-sided printing is conducted by the aforementioned automatic two-sided printing mechanism, commonly, the transfer sheet P, on the first surface of which printing has been completed, is reversed by the trayless device after the fixation of the printed image, and the transfer sheet is fed and held again on the transfer belt 10, and printing is conducted on the second surface. After the completion of printing on the second surface, the transfer sheet is separated from the transfer belt 10. In this case, the mold releasing agent coated in the process of fixation of the first surface image adheres onto the transfer belt 10. As explained in the prior art before, when the surface of the transfer belt, on which the transfer sheet is held after the completion of printing on the first surface, comes into contact with the photoreceptor drum 2, the mold releasing agent moves onto the photoreceptor surface. Due to the mold releasing agent that has moved onto the photoreceptor surface, stripe-shaped oil stains are caused on the image, and the image quality is deteriorated.

In this image forming apparatus, in order to prevent the deterioration of image quality caused by adhesion of oil onto the photoreceptor drum 2, the above two-sided printing mechanism conducts the following specific control operation when printing is continuously conducted on both sides of a plurality of transfer sheets.

The two-sided printing mechanism divides the belt region on the transfer belt 10 at regular intervals for the size of each transfer sheet by the panel dividing method. One transfer sheet is placed in one image region, which will be referred to as a panel hereinafter, so that the transfer sheets, the number of which is an integer, can be always placed on the overall circumference of the transfer belt. When the transfer belt has a seam, the panels are distributed on the transfer belt so that they can not overlap the seam. In this way, the transfer belt is divided into panels. According to the thus divided panels on the transfer belt, the procedure to conduct printing on the first and the second surface is determined. That is, the transfer sheet feed pattern for conduct printing on the first surface and the transfer sheet feed pattern to feed the transfer sheet P via the trayless device for conduct printing on the second surface are determined. In this connection, concerning the feed pattern of the transfer sheet P in the one side printing mode in which printing is conducted on one side, the transfer sheets P are continuously fed and successively held on the divided panels on the transfer belt 10 without skipping.

In this apparatus, when the two-sided printing mode is selected, the divided panels are set on the transfer sheet 10 in accordance with the length in the conveyance direction of the transfer sheet P to be printed. At the same time, the number (S) of the divided panels on the transfer belt 10 is judged which pass through the transfer position of the photoreceptor drum 2K in a period of time from when the transfer sheet P. on the first surface of which printing is conducted, is held on the transfer belt 10 to when the transfer sheet P is fed again to the transfer belt 10 via the transfer sheet conveyance passage of the automatic two-sided printing mechanism. In this case, the transfer sheet conveyance passage of the automatic two-sided printing mechanism includes a sheet reversal conveyance passage 230 and an exclusive two-sided conveyance passage 220. In the actual operation, this number (S) is previously set in accordance with the size and conveyance direction of the transfer sheet. Then, the surplus number (Q) obtained when the number (M) of continuously two-sided printed sheets is divided by the number (S) of the divided panels is computed, and then the two-sided printing is conducted on the transfer sheets, the number of which corresponds to the surplus number (Q). After that, the two-sided printing is conducted on the residual transfer sheets, the number of which is (M−Q). In the way described above, the feed pattern of the transfer sheets P is determined.

Referring to an example, the control operation of the two-sided printing mechanism will be specifically explained in detail as follows.

Figure 2:
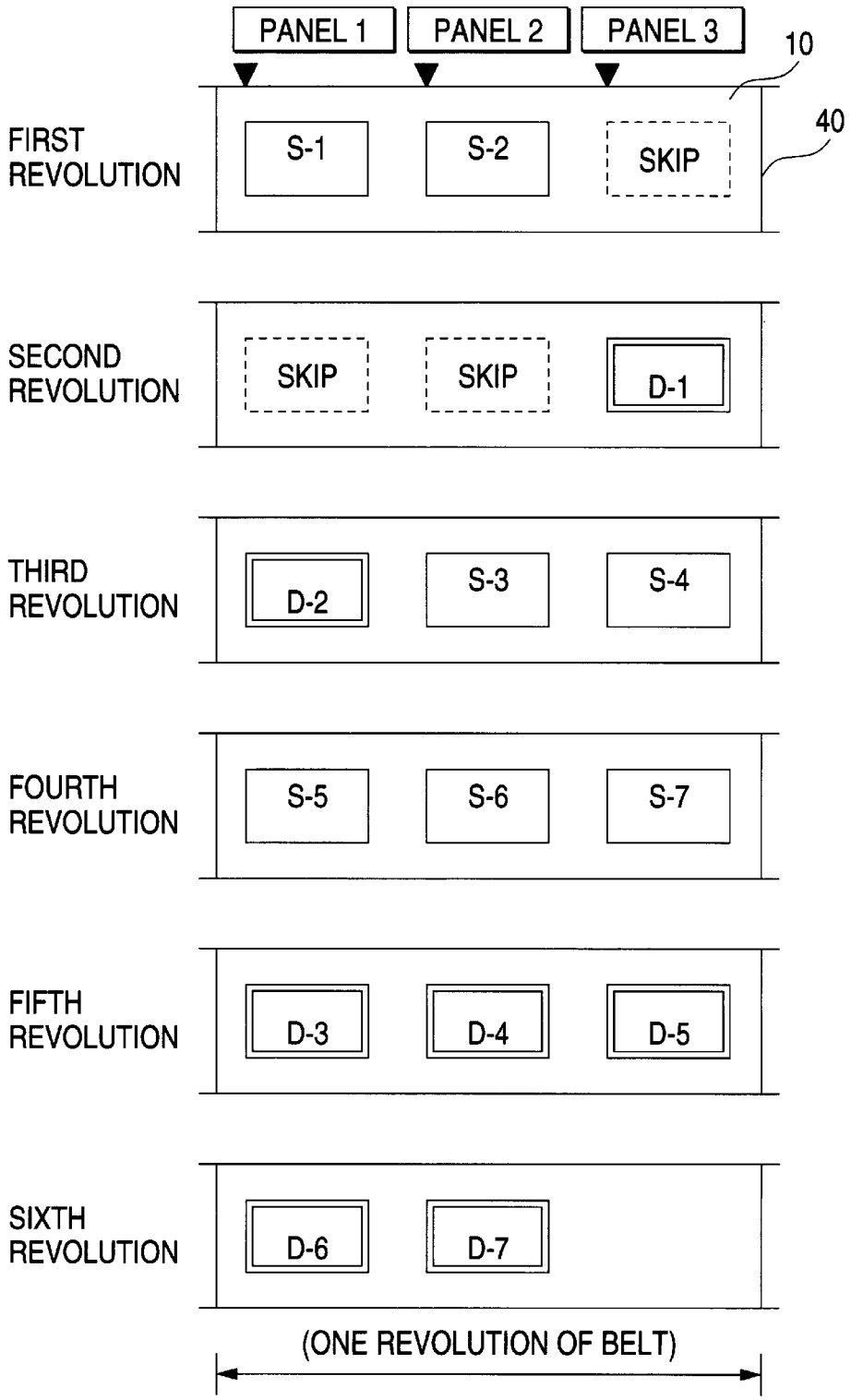
FIG. 2 is a development view showing an example of the model of the transfer sheet conveyance pattern to convey transfer sheets onto a transfer belt divided into panels, the number of which is odd.
Figure 5:
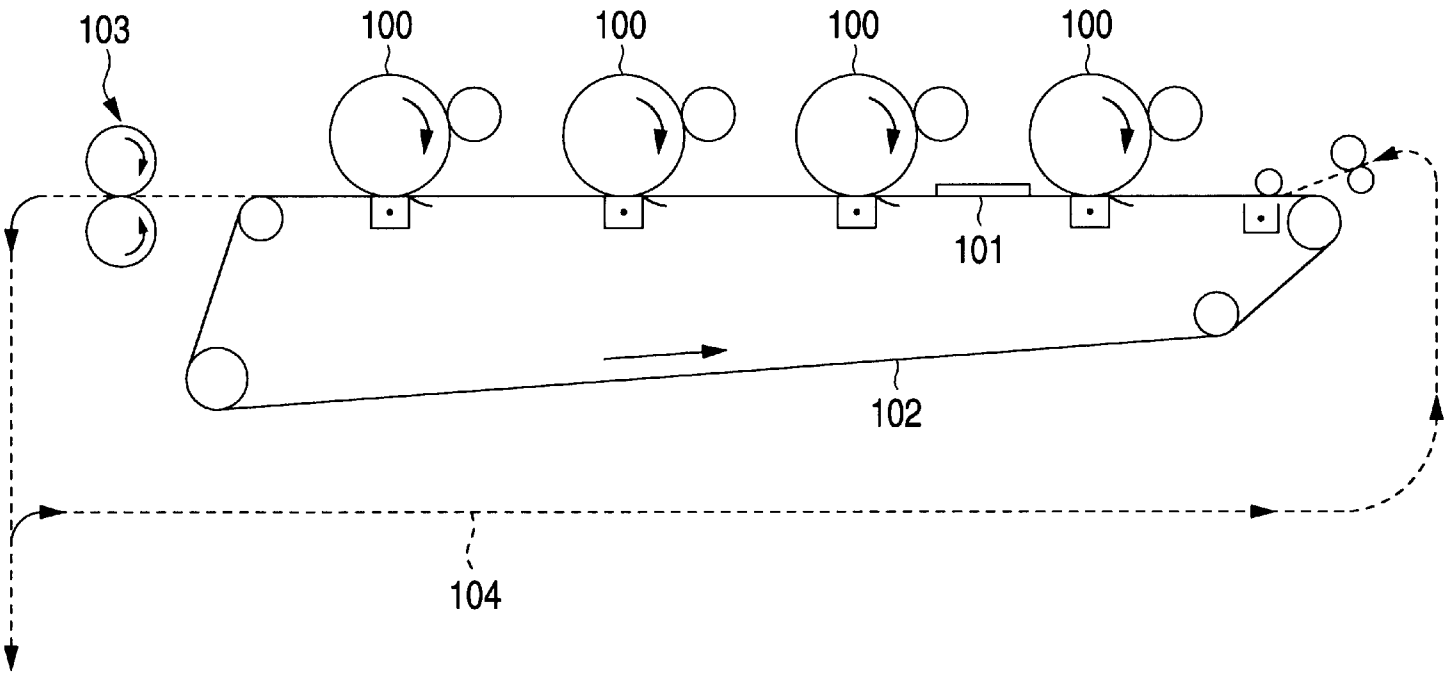
FIG. 5 PRIOR ART
FIG. 5 is a schematic illustration showing an arrangement of the conventional full color image forming apparatus.

FIG. 2 is a view showing a transfer sheet feed pattern in the case of two-sided printing in which 7 transfer sheets of size A3 are held on and conveyed by the transfer belt in the longitudinal direction. FIG. 2 corresponds to FIG. 6 in which the prior art is explained before. In FIG. 2, there is shown a transfer belt 10 having a seam 40. This transfer belt 10 is developed to a sheet-shape for convenience of explanation. The overall length of the belt is equally divided into three portions, which are respectively defined as panels 1, 2 and 3. In this apparatus, a pulse signal is sent from each panel on the transfer belt 10, that is, a pulse signal is generated at each mark of a reverse triangle on the transfer belt 10. In this way, the belt position is detected and controlled at all times.

In the two-sided printing exemplarily shown in FIG. 2, the number (S) of the divided panels with respect to the transfer sheet (S-1), on the first surface of which printing is conducted, is "5". Therefore, when the number (M=7) of transfer sheets, on both sides of which printing is continuously conducted, is divided by the number (M=5), the surplus number (Q) is "2". Therefore, the two-sided printing is previously conducted on the 2 transfer sheets which correspond to the surplus number (Q). After that, the two-sided printing is conducted on the residual transfer sheets, the number of which is (M−Q). In order to accomplish the above operation, the transfer sheets are fed onto the transfer sheets in accordance with the pattern shown in FIG. 2.

The two-sided printing is conducted as follows on the 2 transfer sheets which correspond to the surplus number (Q). Transfer sheets S1 and S2 are fed onto the panels 1 and 2 in the first revolution of the transfer belt, so that the printing is conducted on the first surfaces of the transfer sheets S1 and S2. After the completion of printing, the transfer sheets S1 and S2 are reversed and conveyed by the trayless device. The reversed transfer sheets S1 and S2 are denoted by D1 and D2 in the printing of the second surfaces. The transfer sheets D1 and D2 are respectively conveyed onto the panel 3 in the second revolution and the panel 1 in the third revolution, wherein the panels 1 and 3 are capable of conveying the transfer sheets D1 and D2 first. In this way, printing is conducted on the second surfaces. Then, the two-sided printing is conducted on the residual 5 transfer sheets as follows which correspond to the number (M−Q).

Transfer sheets S3, S4, S5, S6, S7 are respectively conveyed onto the panels 2, 3 in the third revolution, panels 1, 2, 3 in the fourth revolution, and panels 1, 2, 3 in the fifth revolution so as to conduct printing on the first surfaces. After the completion of printing, the transfer sheets are reversed by the trayless device and continuously conveyed onto the panels 1, 2, 3 in the fifth revolution and the panels 1, 2 in the sixth revolution. In this way, printing is conducted on the second surfaces.

In the process of this second surface printing, at a point of time when the final transfer sheet D7 passes through the final photoreceptor drum (2C), all transfer baffles 7 are released from the pushing motion. Due to the foregoing, the transfer belt 10 is separated from each photoreceptor drum. After the separation from the photoreceptor drum, the transfer belt (panel) 10 is cleaned by the cleaner 20 for belt use. In this connection, the transfer belt released from the contact with each photoreceptor drum comes into contact with each photoreceptor drum again by the pushing motion of the transfer baffle 7 immediately before the latent image formation (image exposure) conducted on the first photoreceptor drum 2K after the start of the next image forming operation.

Figure 6:
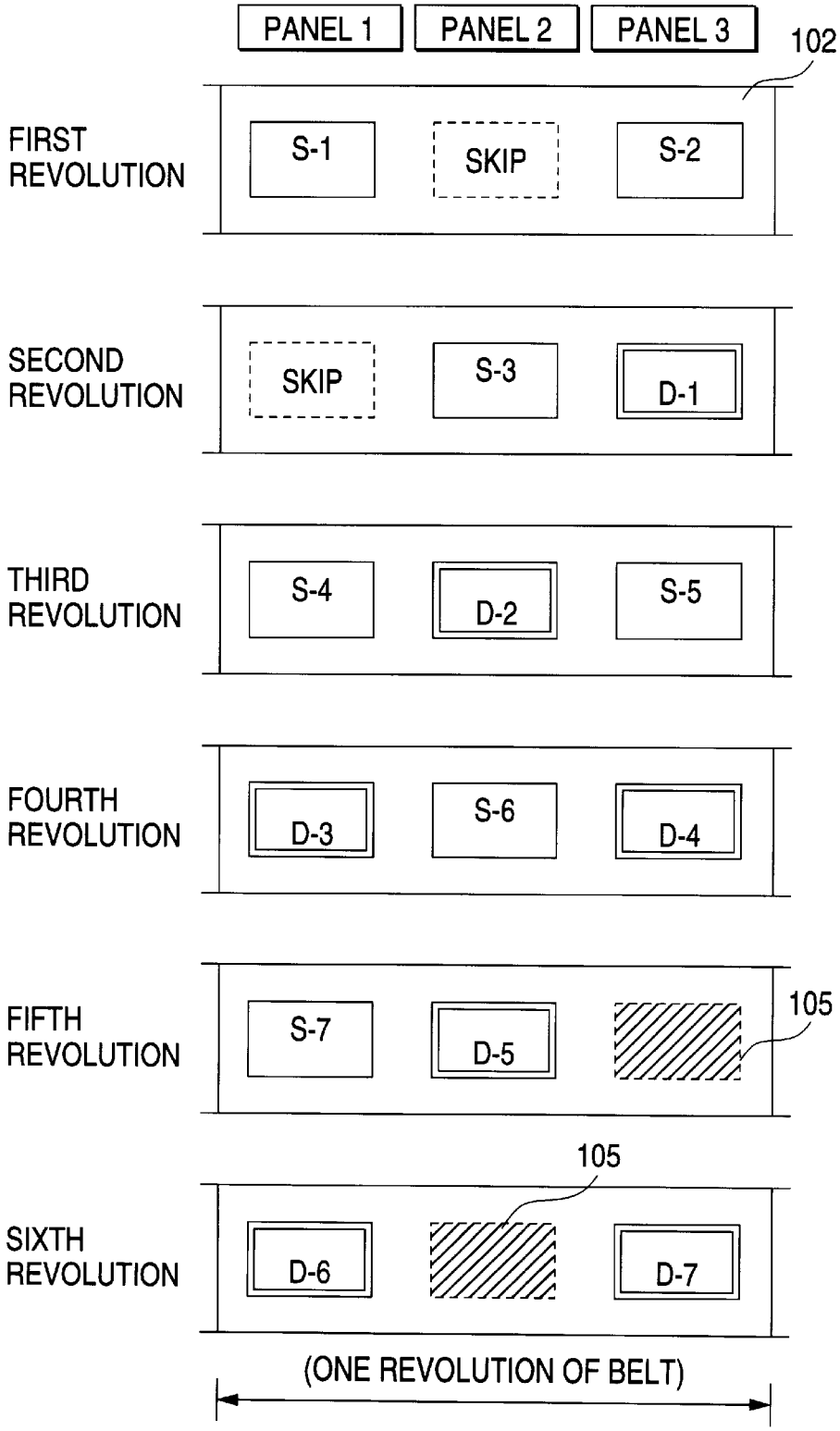
FIG. 6 PRIOR ART

Unlike the sheet conveyance pattern of the prior art shown in FIG. 6, when the two-sided printing is conducted as described above, no "empty panels" are formed on the transfer belt 10. In this case, "the empty panel" is defined as a panel from which the transfer sheet (D), on which the second surface printing has been completed, is separated, and the panel is simply rotated under the condition that no transfer sheet is held on the panel. As a result, after the completion of the first surface printing, the transfer sheet is held again on the panel, and the photoreceptor drum is not directly contacted with the transfer belt onto which the mold releasing agent adheres. Accordingly, no mold releasing agent moves and adheres onto the photoreceptor drum via the transfer belt.

When the two-sided printing is conducted in accordance with the transfer sheet conveyance pattern described above, the two-sided printing conducted on the seventh transfer sheet is completed when the final transfer sheet (D7) is conveyed onto the panel 2 in the sixth revolution. Accordingly, the two-sided printing operation can be completed more quickly than the conventional conveyance pattern shown in FIG. 6, that is, the printing time can be reduced by a period of time corresponding to one panel. In other words, it is possible to prevent the mold releasing agent from adhering onto the photoreceptor drum, and at the same time, it is possible to increase the two-sided printing speed, that is, it is possible to reduce the printing time.

FIG. 3 is a view showing a transfer sheet conveyance pattern in the case of two-sided printing in which 25 transfer sheets of size A5 are held and conveyed by the transfer belt in the longitudinal direction. FIG. 3 shows the transfer sheet conveyance pattern in the form of a table in the same manner as that shown in FIG. 2.

In this case of two-sided printing, the number (S) of divided panels is "9", and the surplus number (Q) obtained when the number (M=25) of transfer sheets, on both sides of which printing is continuously conducted, is divided by the number (S), is "7". Accordingly, the transfer sheets are fed onto the transfer belt in accordance with the pattern shown in FIG. 3 so that the 7 transfer sheets corresponding to the surplus number (Q) can be first subjected to the two-sided printing and then the residual transfer sheets corresponding to the number (M−Q)=18 can be subjected to the two-sided printing. Especially, the two-sided printing for the residual transfer sheets, the number of which is (M−Q), is repeatedly conducted by the number of times corresponding to the quotient, which corresponds to "n" in the above expression, obtained when (M) is divided by (S). That is, after the two-sided printing has been conducted on the eighth to the sixteenth transfer sheet, the two-sided printing is successively conducted on the seventeenth to the twenty-fifth transfer sheet. At a point of time when the final second surface transfer sheet (D25) has passed through the final photoreceptor drum 2C, the transfer belt is separated from all photoreceptor drums by the releasing operation conducted by the transfer baffles.

In the above two-sided printing operation, no "empty panels" described above are not formed. Accordingly, the mold releasing agent that has adhered onto the transfer belt does not move and adhere onto the photoreceptor drum. FIG. 7 is a table on which an example of the transfer sheet conveyance pattern of the prior art is shown for reference. As can be seen in FIG. 7, the mold releasing agent that has adhered onto the hatched panels, that is, the mold releasing agent that has adhered onto the panels 1, 3, 5 in the eleventh revolution and the panel 2 in the twelfth revolution moves and adheres onto the photoreceptor drum.

According to the prior art shown in FIG. 7, the two-sided printing conducted on 25 transfer sheets is completed on the panel 3 in the twelfth revolution of the transfer belt. On the other hand, according to the example of the invention, the two-sided printing conducted on 25 transfer sheets is completed on the panel 2 in the eleventh revolution of the transfer belt.

Accordingly, the printing speed can be increased at a rate corresponding to 8 panels.

FIG. 4 is a table showing a transfer sheet conveyance pattern in which the number of divided panels is set at an even number and the two-sided printing is conducted on 25 transfer sheets. FIG. 8 is a table showing a transfer sheet conveyance pattern of the prior art for reference.

As can be seen in FIGS. 4 and 8, when the transfer belt is divided into portions, the number of which is even, no "empty panels" are formed on the transfer belt. Accordingly, it is possible to prevent the adhesion of a mold releasing agent onto the photoreceptor drum.

In this two-sided printing mechanism, the two-sided printing conducted on 7 transfer sheets corresponding to the surplus number (Q) and the two-sided printing conducted on (M−Q)=18 transfer sheets are carried out in such a manner that the transfer sheets are continuously, successively held on the divided panels without providing the divided panels for 25 skipping on which the transfer sheets are not held. However, according to the prior art, the operation is conducted as follows. According to the prior art, 25 transfer sheets are fed in such a manner that each transfer sheet skips one panel, so that the transfer sheet is fed every two panels, that is, in this example, the transfer sheet is fed onto an odd number panel. Then, the transfer sheet, on which the printing has been completed, is held on the skipped panel (odd number panel) after the circulation in the trayless device, and the first surface printing and the second surface printing are alternately repeated. Due to the foregoing, according to the apparatus of the present invention, a period of time required for the two-sided printing can be reduced by the time corresponding to two panels as compared to the time required for the two-sided printing conducted by the prior art. According to the apparatus of the present invention, when the number of divided panels is set at an even number, it is possible to increase the speed of two-sided printing in some cases.

In the two-sided printing mechanism conducting the control operation as described in the above embodiment, when the one-sided copying or two-sided copying is conducted continuously after the two-sided printing has been conducted on the residual transfer sheets, the number of which is (M−Q), the following specific control operation may be conducted.

A position of the transfer belt 10 is set so that the first transfer sheet (S1) of the first surface of the continuously conducted one-sided copying or two-sided copying can be held by the panel E (the panel 3 in the example shown in FIGS. 2 and 3, and the panel 5 shown in FIG. 4) next to the divided panel on which the last transfer sheet (D7 in the example shown in FIG. 2, and D25 in the examples shown in FIGS. 3 and 4) is held in the two-sided printing conducted on the residual transfer sheets, the number of which is (M−Q). Due to the foregoing, even if the panel E concerned is a panel onto which the mold releasing agent has adhered in the previous two-sided copying operation (however, this panel was temporarily released from the contact with the photoreceptor drum in the previous two-sided copying operation and cleaned by the belt cleaner), since the first transfer sheet (S1) of the next copying is held on this panel, the photoreceptor panel is not directly contacted with this panel. Therefore, at least the mold releasing agent remaining on the panel E concerned is prevented from the adhesion to the photoreceptor drum. Of course, the transfer sheets (S2, S3, etc.) of the second and after in the next copying may be held one by one without skipping, with respect to each panel continuous to the panel E concerned. In this case, the effect of preventing the adhesion of mold releasing agent can be further enhanced.

When the next copying operation is the two-sided copying conducted on a large number of transfer sheets, the following control operation may be combined.

When a transfer sheet of the surplus number (Q), the first surface of which is copied, is fed in such a manner that a skip panel is formed on the transfer belt while the transfer sheet is conveyed again via the trayless mechanism and held by the transfer belt for the copying operation conducted on the second surface, for example, in the case of a conveyance pattern in which the panel 3 to be skipped in the first revolution and the panels 1, 2 to be skipped in the second revolution are provided, the transfer belt 10 is separated from each photoreceptor drum by the releasing operation conducted by the transfer baffle while these skip panels pass through each photoreceptor drum. Simultaneously when these skip panels have passed through each photoreceptor drum, the transfer belt 10 is contacted again with each photoreceptor drum. Due to the above control operation, the panel (transfer belt) onto which the mold releasing agent adhered in the previous process of two-sided copying can not be contacted with the photoreceptor drum, that is, the contact of the panel onto which the mold releasing agent adhered, with the photoreceptor drum can be positively avoided. As a result, adhesion of the mold releasing agent onto the photoreceptor drum can be more positively prevented.

In the above embodiment, when the transfer sheet feed pattern is appropriately set by the two-sided printing mechanism, adhesion of the mold releasing agent onto the photoreceptor drum is prevented. However, according to the present invention, the following specific control operation may be carried out by the two-sided printing mechanism.

For example, in the conventional transfer sheet conveyance pattern shown in FIG. 6, the transfer baffle 7 may be released from the pushing operation only while "the empty panel" 105 passes through each photoreceptor drum 2, so that "the empty panel" is not contacted with each photoreceptor drum 2 and the mold releasing agent is prevented from adhering onto the photoreceptor drum. In this case, the mold releasing agent adhering onto "the empty panel" is removed by the cleaner for belt use.

In the same transfer sheet conveyance pattern, a new transfer sheet may be fed from the sheet feed tray to "the empty panel" 105 on the transfer belt onto which the mold releasing agent adheres. Since the transfer sheet is held on "the empty panel" 105, each photoreceptor drum 2 is not directly contacted with "the empty panel", so that the mold releasing agent is prevented from adhering onto the photoreceptor drum. The mold releasing agent that has adhered onto the transfer belt is a little absorbed by the thus fed transfer sheet. In this case, the transfer sheet which has been fed for the prevention of adhesion of the mold releasing agent is delivered from the apparatus after it has passed through the final photoreceptor drum.

Further, in the same transfer sheet conveyance pattern, toner may be made to adhere by the developing unit to a portion on the surface of the photoreceptor drum coming into contact with "the empty panel" 105 on the transfer belt onto which the mold releasing agent has adhered. When the toner is interposed between the photoreceptor drum and "the empty panel", "the empty panel" is not contacted with each photoreceptor drum 2, so that the mold releasing agent can be prevented from adhering onto the photoreceptor drum. In this case, a two-component type developing unit may be adopted, and the developer that has moved from the transfer belt onto the photoreceptor drum may be scraped off by the magnetic brush of the two-component type developing unit so that the adhesion of the mold releasing agent onto the photoreceptor drum can be prevented. In this case, the mold releasing agent that has been scraped off at this time is recovered into the developing unit together with the developer. The thus recovered mold releasing agent is used in the developing process together with the developer and delivered outside the apparatus together with the transfer sheet.

As explained above, in the image forming apparatus of the present invention, it is possible for the rotary image carrier not to directly come into contact with the divided holding region surface on the transfer sheet holding rotary body onto which a transfer sheet fed again by the automatic two-sided image forming means of the trayless device is held. As a result, it is possible to solve the problem of low image quality originated from the adhesion of the mold releasing agent onto the rotary image carrier. In this case, the speed of the two-sided image formation is not lowered, that is, the time required for the two-sided image formation is not increased.

Concerning the control operation conducted by the control means, the two-sided image formation is previously conducted on the transfer sheets, the number of which corresponds to the surplus number obtained when the number of transfer sheets of continuous two-sided image formation is divided by the number of the divided holding regions on the transfer sheet holding rotary body passing through a transfer position on the rotary image carrier in a period of time from when a transfer sheet, onto the first image surface of which an image is formed, is held on the transfer sheet holding rotary body to when the transfer sheet is fed again to the transfer sheet carrying rotary body via a transfer sheet conveyance passage of the automatic two-sided image forming means, when the two-sided image formation is continuously conducted on a plurality of transfer sheets. As a result, it is possible to solve the problem of low image quality originated from the adhesion of the mold releasing agent onto the rotary image carrier. In this case, the speed of the two-sided image formation is not lowered, that is, the time required for the two-sided image formation is not increased.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming apparatus comprising:

a rotary image carrier on which a toner image is formed;

a transfer sheet carrying rotary body arranged at a transfer position of said rotary image carrier, for carrying a plurality of transfer sheets onto which the toner image is transferred from said rotary image carrier;

fixing means for fixing the transferred toner onto the transfer sheets, the fixing means having mold releasing agent coating means;

automatic trayless two-sided image forming means for feeding again a transfer sheet, the transfer sheet having a first surface onto which the toner image has been fixed, to said transfer sheet carrying rotary body without temporarily accommodating the transfer sheet, and for forming an image on a second surface of the transfer sheet while the transfer sheet is being held in a divided holding region on said transfer sheet carrying rotary body which is previously set before the start of image formation; and control means for conducting a control operation so that the divided holding region surface of said transfer sheet carrying rotary body, on which the transfer sheet fed again by said automatic two-sided image forming means is held, is prevented from being directly contacted with said rotary image carrier.

2. The image forming apparatus according to claim 1, wherein the control operation is conducted to feed the transfer sheet so that the transfer sheet is held on the divided holding region surface of said transfer sheet carrying rotary body, onto which the transfer sheet fed again is held.

3. The image forming apparatus according to claim 1, wherein the control operation is conducted to previously deposit toner on at least a surface of said rotary image carrier which comes into contact with the divided holding region surface of said transfer sheet carrying rotary body, onto which the transfer sheet fed again is held.

4. The image forming apparatus according to claim 1, wherein two-sided image formation is first conducted on a surplus number of transfer sheets, the surplus number corresponding to a number obtained when the total number of a plurality of transfer sheets for continuous two-sided image formation is divided by the number of the divided holding regions on said transfer sheet holding rotary body passing through a transfer position on said rotary image carrier in a period of time from when a transfer sheet having a first image surface on which an image is formed is held on said transfer sheet holding rotary body to when the transfer sheet is fed again to said transfer sheet carrying rotary body via a transfer sheet conveyance passage of said automatic two-sided image forming means, and then the two-sided image formation is conducted on a residual number of transfer sheets, the residual number of transfer sheets being the total number of the plurality of transfer sheets minus the surplus number of transfer sheets.

5. The image forming apparatus according to claim 4, wherein the transfer position of said rotary image carrier through which the divided holding region passes is located at a transfer position of said first rotary image carrier arranged on a side to which the transfer sheet is fed when a plurality of rotary image carriers are arranged around said transfer sheet holding rotary body.

6. The image forming apparatus according to claim 4, wherein for any number of transfer sheets the two-sided image formation conducted on the surplus number of transfer sheets and the two-sided image formation conducted on the residual number of transfer sheets are respectively conducted under the condition that the transfer sheet, onto the first surface of which an image is formed, and the transfer sheet, onto the second surface of which an image is formed, are successively held in the divided holding regions on said transfer sheet holding rotary body, without setting a divided holding region for skipping in which a transfer sheet is not held.

7. The image forming apparatus according to claim 6, wherein the number of the divided holding regions on said transfer sheet holding rotary body is an even number.

8. The image forming apparatus according to claim 4, wherein the transfer sheet holding rotary body is displaced so as to be separated from said rotary image carrier after the completion of transfer conducted on the second surface in the two-sided image formation conducted on the residual number of transfer sheets.

9. An image forming apparatus comprising:

a rotary image carrier on which a toner image is formed;

a transfer sheet carrying rotary body arranged at a transfer position of said rotary image carrier, for carrying a plurality of transfer sheets onto which the toner image is transferred from said rotary image carrier;

fixing means for fixing the transferred toner onto the transfer sheets, the fixing means having mold releasing agent coating means;

automatic two-sided image forming means for feeding again a transfer sheet, the transfer sheet having a first surface onto which the toner image has been fixed, to said transfer sheet carrying rotary body without temporarily accommodating the transfer sheet, and for forming an image on a second surface of the transfer sheet while the transfer sheet is being held in a divided holding region on said transfer sheet carrying rotary body which is previously set before the start of image formation; and control means for conducting a control operation so that the divided holding region surface of said transfer sheet carrying rotary body, on which the transfer sheet fed again by said automatic two-sided image forming means is held, is prevented from being directly contacted with said rotary image carrier, wherein the control operation is conducted to displace said transfer sheet carrying rotary body so that the divided holding region surface of said transfer sheet carrying rotary body, onto which the transfer sheet fed again is held, is separated from said rotary image carrier.

10. The image forming apparatus of claim 9, wherein the automatic two-sided image forming means is trayless.

11. An image forming apparatus comprising:

a rotary image carrier on which a toner image is formed;

a transfer sheet carrying rotary body arranged at a transfer position of said rotary image carrier, for carrying a plurality of transfer sheets onto which the toner image is transferred from said rotary image carrier;

fixing means for fixing the transferred toner onto the transfer sheets, the fixing means having mold releasing agent coating means;

automatic two-sided image forming means for feeding again a transfer sheet, the transfer sheet having a first surface onto which the toner image has been fixed, to said transfer sheet carrying rotary body without temporarily accommodating the transfer sheet, and for forming an image on a second surface of the transfer sheet while the transfer sheet is being held in a divided holding region on said transfer sheet carrying rotary body which is previously set before the start of image formation; and control means for conducting a control operation so that for any number of transfer sheets the divided holding region which has been previously set holds the transfer sheet which has been fed again to the transfer sheet carrying rotary body to permit successively holding any successive transfer sheet in a respective successive divided holding region without skipping a divided holding region from the divided holding region which has been previously set.

12. The image forming apparatus of claim 11, wherein the automatic two-sided image forming means is trayless.

* * * * *